US012522336B1

(12) United States Patent
Harding et al.

(10) Patent No.: US 12,522,336 B1
(45) Date of Patent: Jan. 13, 2026

(54) OUTBOARD MARINE DRIVES HAVING SPLASH PLATE

(71) Applicant: Brunswick Corporation, Mettawa, IL (US)

(72) Inventors: Duane Harding, Stillwater, OK (US); Daniel A. Roske, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 493 days.

(21) Appl. No.: 18/092,797

(22) Filed: Jan. 3, 2023

Related U.S. Application Data

(60) Provisional application No. 63/424,708, filed on Nov. 11, 2022.

(51) Int. Cl.
*B63H 20/34* (2006.01)
*B63H 20/06* (2006.01)

(52) U.S. Cl.
CPC ..... *B63H 20/34* (2013.01); *B63H 20/06* (2013.01)

(58) Field of Classification Search
CPC ..... B63H 20/34; B63H 20/06
See application file for complete search history.

(56) References Cited

U.S. PATENT DOCUMENTS 3,953,053 A * 4/1976 Arenhold ..... B62D 25/18 280/851
4,379,702 A 4/1983 Takada
4,505,010 A * 3/1985 Arenhold ..... F16B 2/245 267/74
4,781,634 A * 11/1988 Harris ..... B63H 20/34 440/66
5,052,960 A 10/1991 Kato
5,328,395 A 7/1994 Oishi
5,573,436 A 11/1996 Trudeau
5,967,865 A * 10/1999 Nakamura ..... B63H 20/34 440/52
6,287,161 B1 9/2001 Nozawa
7,247,065 B2 7/2007 Ito
7,390,232 B1 6/2008 English et al.
7,524,223 B2 4/2009 Ochiai et al.
8,651,906 B1 2/2014 Morton
9,017,121 B1 4/2015 Amerling
9,216,805 B1 12/2015 Amerling et al.
9,341,008 B1 5/2016 Amerling et al.
9,463,859 B1 10/2016 Cooper, III
9,580,943 B1 2/2017 Amerling et al.
9,580,947 B1 2/2017 Amerling et al.
(Continued)

OTHER PUBLICATIONS

Office Action issued in U.S. Appl. No. 18/195,691, dated Nov. 7, 2025.

*Primary Examiner* — Stephen P Avila
(74) *Attorney, Agent, or Firm* — Andrus Intellectual Property Law, LLP

(57) ABSTRACT

An outboard marine drive has a supporting frame, a lower unit suspended from the supporting frame, the lower unit supporting a propulsor for propelling the outboard marine drive in water, a top cowl on the supporting frame, wherein a gap is defined between a lower end portion of the top cowl and the supporting frame or the lower unit, and a splash plate on the lower unit, the splash plate being configured to reduce inflow of water to the top cowl via the gap.

17 Claims, 12 Drawing Sheets

(56) References Cited

U.S. PATENT DOCUMENTS

| | | | |
|---|---|---|---|
| 9,963,213 | B1 | 5/2018 | Jaszewski et al. |
| 10,005,534 | B1 | 6/2018 | Amerling et al. |
| 10,150,549 | B1 | 12/2018 | Amerling et al. |
| 10,202,180 | B1 | 2/2019 | Amerling et al. |
| 10,286,989 | B1 | 5/2019 | Amerling et al. |
| 10,336,429 | B1 | 7/2019 | Amerling et al. |
| 10,351,222 | B1 | 7/2019 | Amerling et al. |
| 10,464,648 | B1 | 11/2019 | Amerling et al. |
| 10,710,691 | B2 | 7/2020 | Amerling et al. |
| 10,718,142 | B1 | 7/2020 | Amerling et al. |
| 11,130,555 | B1 | 9/2021 | Foulkes et al. |
| 11,312,462 | B1 | 4/2022 | Faust et al. |
| 11,352,116 | B1 | 6/2022 | Amerling et al. |
| 11,486,340 | B1 | 11/2022 | Gunderson et al. |
| 11,542,735 | B1 | 1/2023 | Amerling et al. |
| 11,577,809 | B1 | 2/2023 | Faust et al. |
| 2006/0135008 | A1 | 6/2006 | Ito |
| 2006/0258234 | A1 | 11/2006 | Ito |
| 2015/0367924 | A1 | 12/2015 | Davis |
| 2016/0001864 | A1 | 1/2016 | Davis |
| 2022/0266967 | A1 | 8/2022 | Kraus et al. |

* cited by examiner

OUTBOARD MARINE DRIVES HAVING SPLASH PLATE

CROSS-REFERENCE TO RELATED APPLICATION

The present application claims the benefit of and priority to U.S. Provisional Patent Application Ser. No. 63/424,708, filed Nov. 11, 2022, which is hereby incorporated herein by reference, in entirety.

FIELD

The present disclosure relates to outboard marine drives for propelling a marine vessel in water, and particularly outboard marine drives having a cowling and a splash plate.

BACKGROUND

The following U.S. Patents are incorporated herein by reference in entirety:

U.S. Pat. No. 10,336,429 discloses a cowling for an outboard motor that has port and starboard intake ports that direct flow of intake air into the cowling and extend downwardly along the aftward side of the cowling and face laterally outwardly. A duct system receives and conveys intake air intake ports to an intake conduit for the outboard motor. The duct system includes port and starboard intake troughs that extend alongside the intake ports and redirect the intake air from a generally lateral flow into the intake ports to a generally vertically downward flow and then to a generally forward flow towards the intake conduit. Port and starboard baffles extend alongside the intake ports and direct flow of water into port and starboard channels located alongside the baffles, respectively. The channels drain the water by gravity depending on tilt and trim orientation of the outboard motor.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 7,524,223 discloses an outboard motor that is capable of reliably separating water and air sucked in from an intake port and efficiently draining the separated water. The motor can comprise a cowling, a right-side intake port, a left-side intake port, first and second water separating portions, a communication port, and an engine compartment. The right-side intake port can be formed in a right side surface portion of an upper portion of the cowling. The left-side intake port can be formed in a left side surface portion of the upper portion of the cowling. The first water separating portion can have an intake passage communicating between the right-side intake port and the left-side intake port. The second water separating portion can communicate with the first water separating portion through the communication port, and the second water separating portion can communicate with the engine compartment.

U.S. Pat. No. 11,486,340 discloses a cowling for an outboard motor which extends from port side to starboard side in a lateral direction. The cowling includes port and starboard inlets that direct flow of intake air into the cowling and face outwardly in the lateral direction. The cowling further comprises port and starboard duct systems. Each duct system is configured to receive and convey intake air from one of the port and starboard intake ports to an intake conduit for the outboard motor. Each duct system defines a first separation region that receives and conveys the intake air laterally outward to separate a first portion of water from the intake air. Each duct system further defines a second separation region that receives and conveys the intake air from the first separation region laterally inward to separate a second portion of water from the intake air.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In non-limiting examples disclosed herein, an outboard marine drive has a supporting frame, a lower unit suspended from the supporting frame, the lower unit supporting a propulsor for propelling the outboard marine drive in water, a top cowl on the supporting frame, wherein a gap is defined between a lower end portion of the top cowl and the supporting frame or the lower unit, and a splash plate on the lower unit, the splash plate being configured to reduce inflow of water to the top cowl via the gap.

In some examples, the splash plate may comprise a flange radially outwardly extending from the lower unit. The flange may have a radially lower surface having an outer perimeter which is completely flat. The flange may have a width which is larger than a width of the gap. The width of the flange may be greater along a forward side of the lower unit than along a rearward side of the lower unit.

In some examples, the splash plate may be located between the top cowl and a torpedo housing of the outboard marine drive. The splash plate may be located between the top cowl and an anti-cavitation plate of the outboard marine drive. The splash plate may be clamped to an outer surface of the lower unit. The splash plate may be clamped to an outer surface of the lower unit by only one fastener. Said one fastener may be located along a rear side of the lower unit.

In some examples, the splash plate may be an elongated flexible member having a curved shape which can be deformed out of said curved shape during installation on an outer surface of the lower unit. The elongated flexible member may tend to return to said curved shape after said installation, facilitating retention of the splash plate in place on the outer surface of the lower unit. The lower unit may have an outer profile which is a tear-drop shape having a wider width at a forward side of the lower unit and a relatively narrower width at a rearward side of the lower unit, and wherein the curved shape of the elongated flexible member may be a corresponding tear-drop shape. The splash plate may be clamped to an outer surface of the lower unit by only one fastener.

In some examples the splash plate may be an elongated flexible member having a curved shape which can be deformed out of said curved shape during installation on an outer surface of the lower unit wherein the elongated flexible member has opposing ends and further wherein the splash plate is clamped to the outer surface of the lower unit by only one fastener which fastens the opposing ends together. The fastener may laterally extend into the opposing ends. The splash plate may comprise a collar and a flange which radially outwardly extends from the collar. The flange may be located between the top cowl and the collar. The flange may also be located beneath the collar. The outboard marine drive may further comprise pressure sensitive adhesive tape adhering an inner surface of the collar to an outer surface of the lower unit.

In non-limiting examples disclosed herein, a splash plate is for an outboard marine drive. The splash plate comprises an elongated flexible member having a curved shape which can be deformed out of said curved shape during installation on an outer surface of a lower unit of the outboard marine drive. The elongated flexible member tends to return to said curved shape after said installation, facilitating retention of the splash plate in place on the outer surface of the lower unit. The splash plate is clamped to the outer surface of the lower unit by only one fastener. In some examples, the elongated flexible member may have opposing ends, and further wherein the only one fastener fastens the opposing ends together.

BRIEF DESCRIPTION OF THE DRAWINGS

The present disclosure includes the following drawing figures.

DETAILED DESCRIPTION

Figure 1:
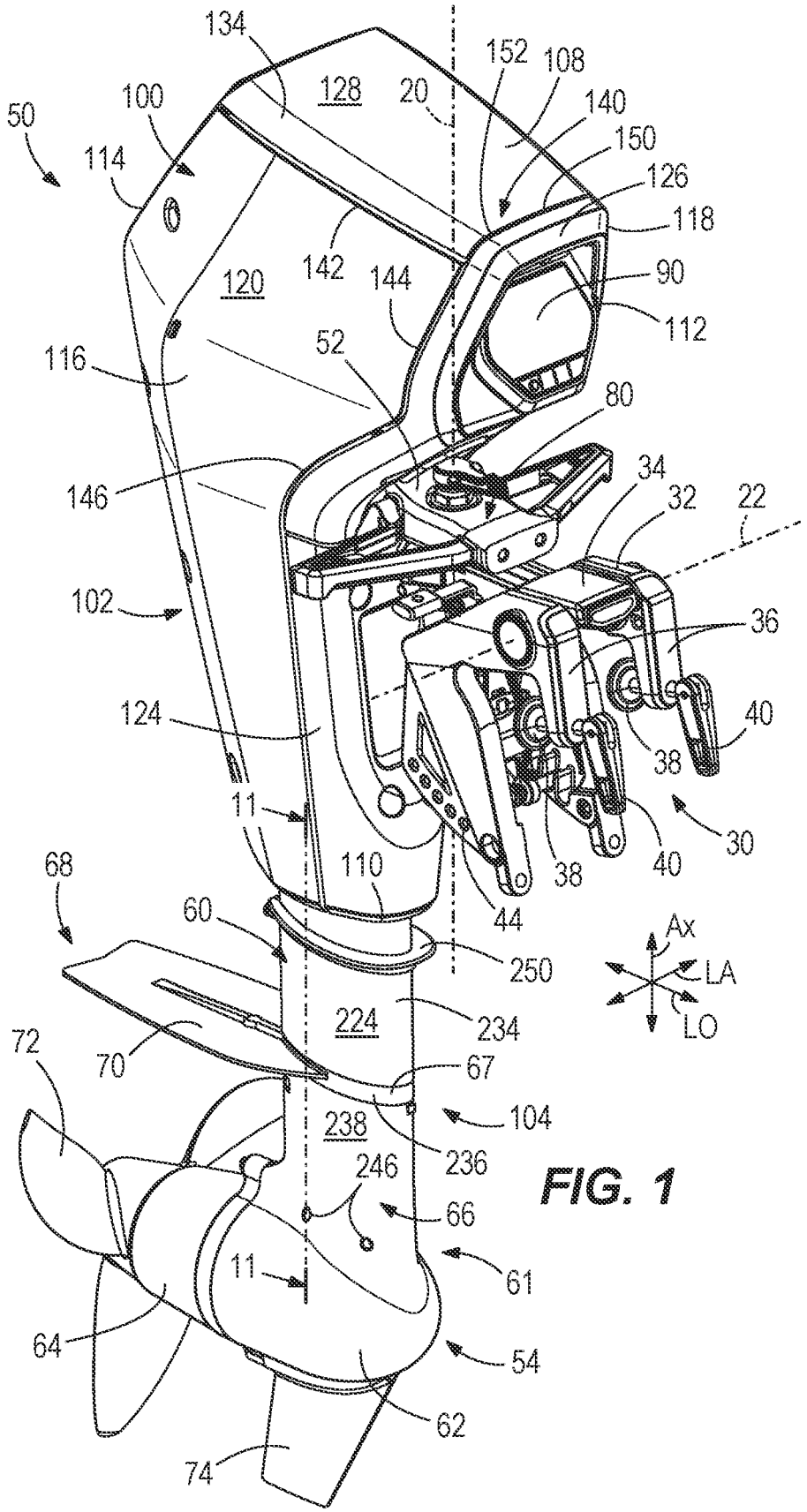
FIG. 1 is a perspective view of a marine drive supported on a transom bracket assembly.

FIG. 1 depicts a marine drive 50 for propelling a marine vessel in a body of water. In the illustrated embodiment, the marine drive 50 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. A transom bracket assembly 30 supports the marine drive 50 on the transom (not shown) of the marine vessel such that the marine drive 50 is trimmable up and down relative to the transom bracket assembly 30, including in non-limiting examples wherein the marine drive 50 is raised completely out of the water.

Figure 11:
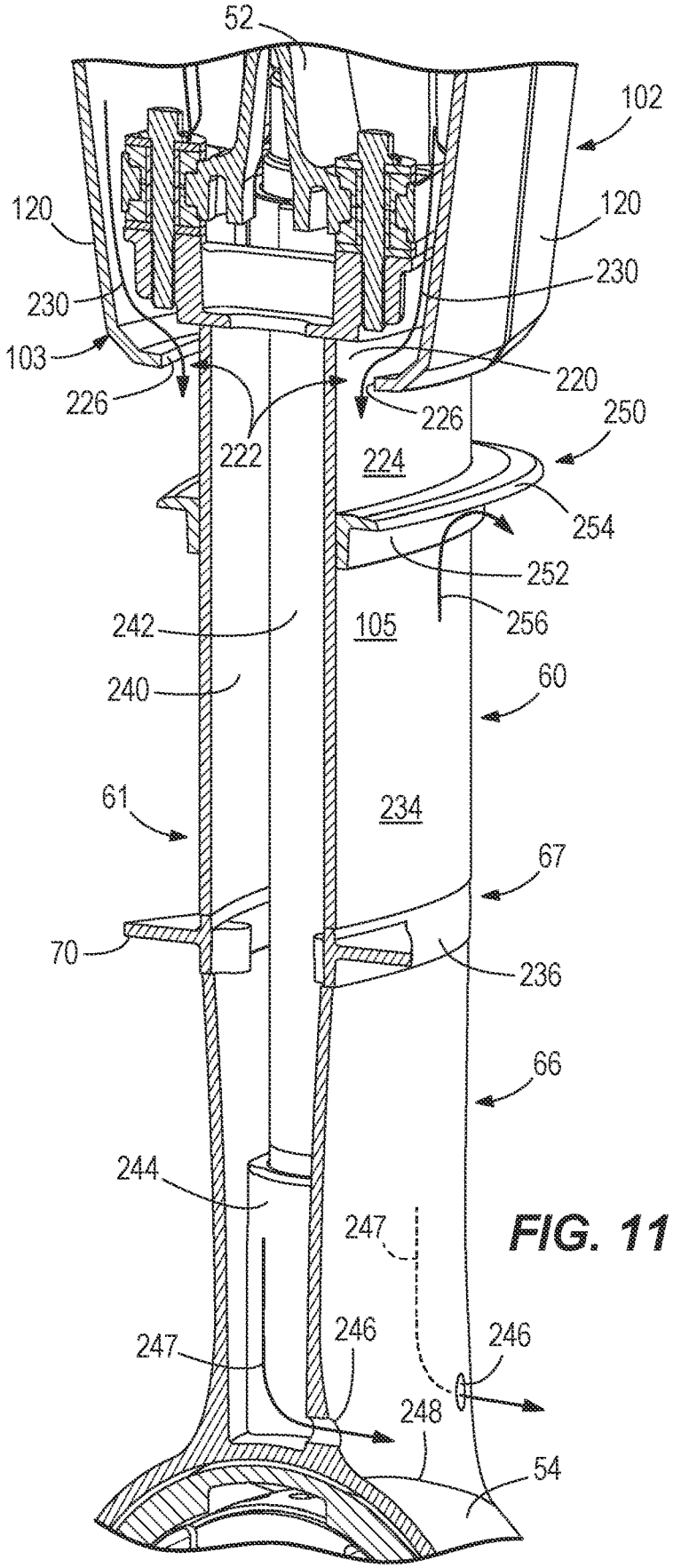
FIG. 11 is a view of section 11-11, taken in FIG. 1.

The marine drive 50 includes a supporting frame 52 (lower end shown in FIG. 11) for rigidly supporting the various components of the marine drive 50 with respect to the marine vessel and a lower unit 61 supported by the supporting frame 52. The supporting frame 52 has body (not shown) and a support leg extending downwardly from the bottom of the body. A lower end of the support leg is coupled to the lower unit 61 of the marine drive 50, which generally includes a torpedo housing 54, a stem 66, an extension leg 60, and an anti-ventilation plate 68 disposed between the stem 66 and the extension leg 60. The anti-ventilation plate 68 has a head 67 positioned between the extension leg 60 and the stem 66 and includes a generally flat anti-cavitation plate 70 that extends rearwardly from the extension leg 60. As discussed in further detail below, the extension leg, 60, the head 67 of the anti-ventilation plate 68, and the stem 66 generally form a lower cowl 104 that is supported by the supporting frame 52.

The torpedo housing 54 has a front housing portion 62 and a rear housing portion 64 which are mated together and define a watertight lower housing cavity for containing a motor (not shown) and related componentry. The front housing portion 62 has a nosecone with a smooth outer surface which transitions to the upwardly extending stem 66 and a downwardly extending skeg 74. A conventional propulsor 72 is mounted on the outer end of a propulsor shaft extending from the torpedo housing 54 such that rotation of the propulsor shaft by the motor causes rotation of the propulsor 72, which in turn generates a thrust force for propelling the marine vessel in water. It should be understood that the various components described above are exemplary and could vary from what is shown.

With continued reference to FIG. 1, the marine drive 50 is coupled to the transom (not shown) of a marine vessel by a transom bracket assembly 30, which in the illustrated example includes a transom bracket 32 configured to be fixed to the transom and a swivel bracket 34 pivotably coupled to the transom bracket 32. The transom bracket 32 has a pair of C-shaped arms 36 which fit over the top of the transom and a pair of threaded, plunger-style clamps 38 which clamp the C-shaped arms 36 to the transom. Rotation of handles 40 in one direction clamps the transom between the C-shaped arms 36 and plunger-style clamps 38. Rotation of the handles 40 in the opposite direction frees the C-shaped arms 36 for removal from the transom. In some embodiments, the transom bracket 32 is additionally or alternatively fixed to the transom by at least one fastener (not shown).

The swivel bracket 34 is pivotable with respect to the C-shaped arms 36 about a pivot shaft that laterally extends through the forward upper ends of the C-shaped arms 36, thereby defining a trim axis 22. Pivoting of the swivel bracket 34 about the pivot shaft trims the marine drive 50 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the marine drive 50. A selector pin (not shown) can be manually inserted into the aligned holes to thereby lock the marine drive 50 in place with respect to the trim axis 22.

The marine drive 50 is supported on the swivel bracket 34 by a steering arm 80, which extends from the body 82 of the supporting frame 52 of the marine drive 50, generally along the midsection of the marine drive 50. A swivel tube assembly (not shown) extends transversely from the steering arm 80 and is removably received in a swivel cylinder (not shown) of the swivel bracket 34. The marine drive 50 can be steered left or right relative to the marine vessel by rotating about the steering axis 20, which is defined by the swivel tube and swivel cylinder, via a manually operable tiller (not shown) and/or any other known apparatus for steering a marine drive with respect to a marine vessel.

In the illustrated embodiments, the marine drive 50 includes a cowling 100 with a top cowl 102 and a lower cowl 104. The cowling 100 extends from a top 108 to a bottom 110 in an axial direction, from a front 112 to a rear 114 in a longitudinal direction which is perpendicular to the axial direction, and from a port side 116 to a starboard side 118 in a lateral direction which is perpendicular to the axial direction and perpendicular to the longitudinal direction. The top cowl 102 includes a plurality of cowl panels 120-126 and defines a cowling interior 106 in which a portion of the supporting frame 52 is enclosed and various components of the marine drive 50 are disposed. In the illustrated embodiments, the top cowl 102 includes starboard and port side panels 120, a rear panel 122, a lower front panel 124, an upper front panel 126. The upper front panel 126 is configured to support a display screen 90. A lid 128 is positioned on the top cowl 102 and is pivotable into and between an open and closed position. In the open position, the lid provides access to the cowling interior 106 through an opening 130 into the interior 106. In the closed position, the lid 128 encloses the cowling interior 106.

Figure 3:
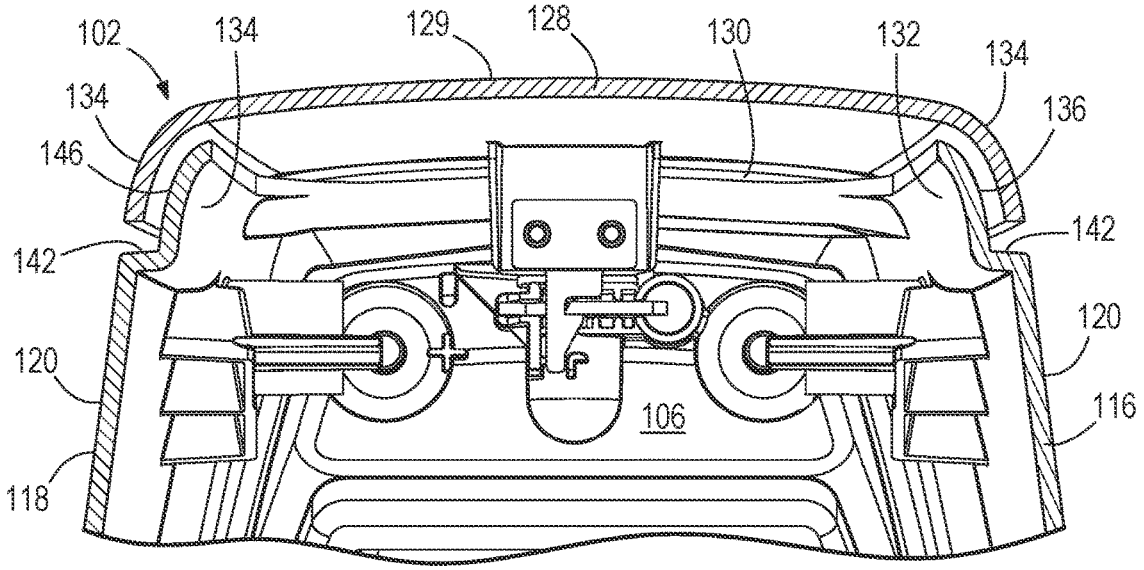
FIG. 3 is a view of section 3-3, taken in FIG. 2.
Figure 4:
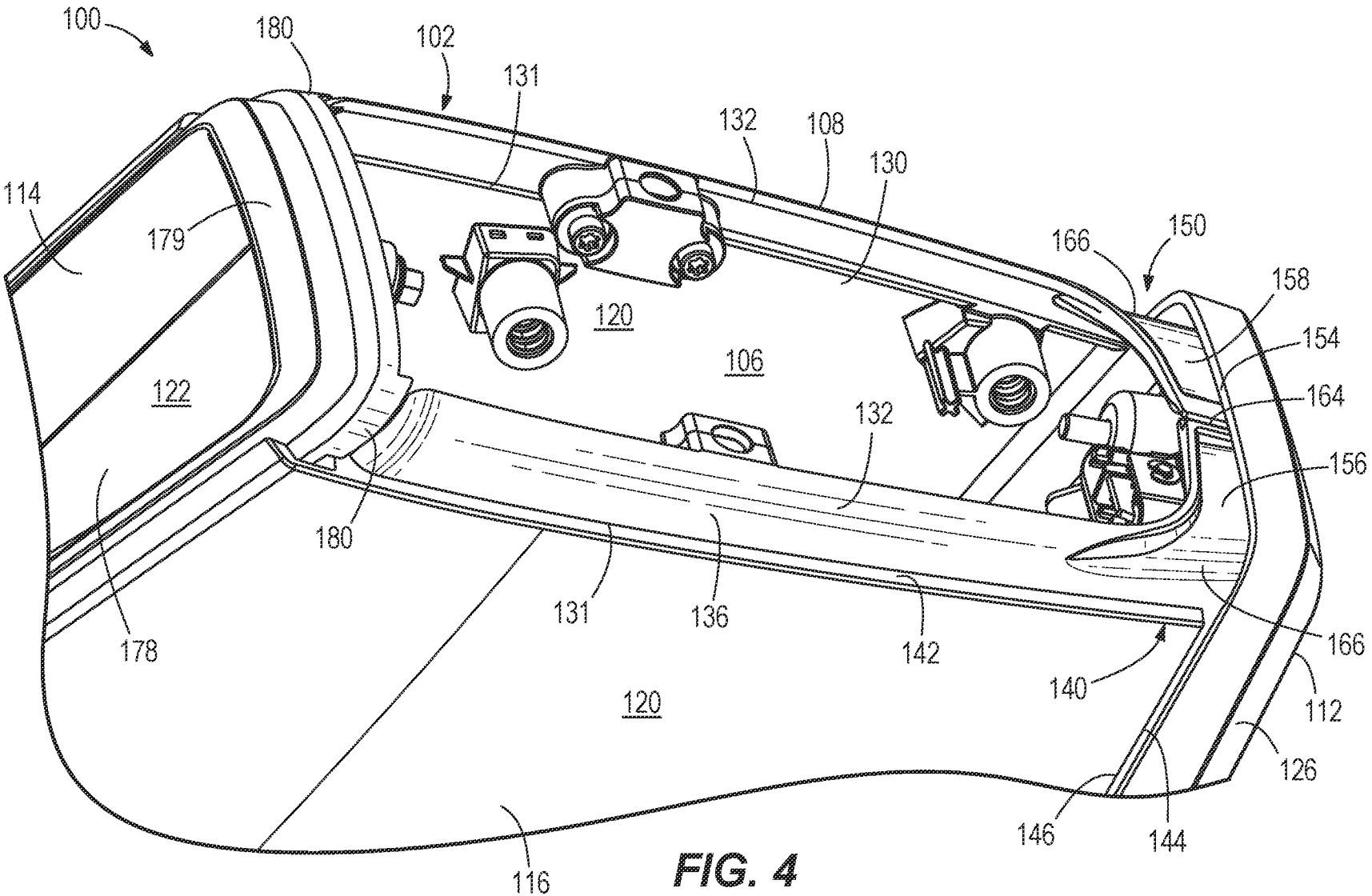
FIG. 4 is a detailed perspective view of the top cowl for the marine drive of FIG. 2 with the lid removed.
Figure 5:
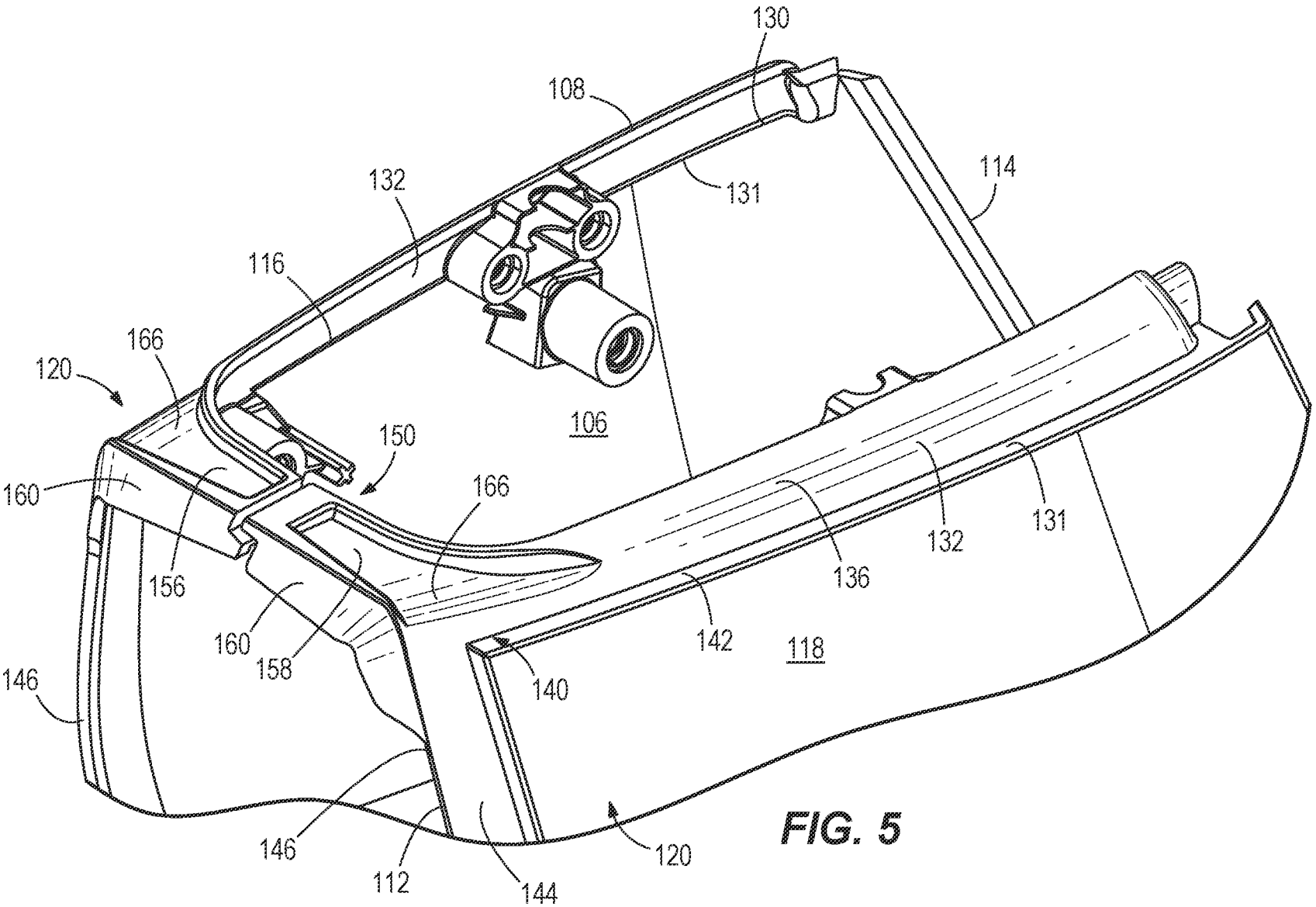
FIG. 5 is a detailed perspective view of the side cowling panels of the top cowl of FIG. 4.

Referring to FIGS. 3-5, the top cowl 102 includes an upper lip 132 extending along an upper edge 131 of the side panels 120. The upper lip 132 is offset laterally inwards from the outer surfaces of the side panels 120 and turns radially inwardly towards the cowling interior 106. As best illustrated in FIG. 3, when in the closed position, the lid 128 overlaps the upper lip 132. In particular, the illustrated lid 128 includes opposite port and starboard edge portions 134 that overlap and are turned downwardly towards the port side 116 and the starboard side 118 of the top cowl 102, respectively. Thus, the upper lip 132 provides a deflector 136 for the water configured to deflect water and restrict its flow into the cowling interior 106.

Referring to FIGS. 2-5, the cowling 100 includes a novel trough system 140 that is configured to drain water by gravity from the lid 128 and the top cowl 102. The trough system 140 is located below the lid 128 and may be at least partially defined by the upper lip 132. In the illustrated embodiments, for example, the trough system 140 and the upper lip 132 are one piece formed with the side panels 120. Some embodiments, however, may include a cowling with an upper lip and trough system that are separate parts.

On the port and starboard sides 116, 118 of the top cowl 102, the trough system 140 includes port and starboard gutters 142 configured to convey water from the lid 128 longitudinally along the port side 116 and the starboard side 118 of the cowling 100, respectively, for removal from the cowling 100. The port and starboard gutters 142 are sloped downwardly towards the front 112 of the cowling 100 such that the water drains by gravity towards the front 112 of the cowling 100 and into an axially extending channel 144. Proximate the front 112 of the cowling 100, the port and starboard gutters 142 are respectively connected to port and starboard channels 144. The channels 144 are configured to convey water from the port and starboard gutters 142 downwardly along the port or starboard side 116, 118 of the cowling 100, respectively. In the illustrated embodiments, the channels 144 extend downwardly along a front edge 146 of the side panels 120 and generally follow the contours of the front 112 of the cowling 100. Some embodiments, however, may have a port channel and/or a starboard channel that take a different downwardly route across the respective side 116, 118 of the top cowl 102.

The trough system 140 includes a drain gutter 150 located at or near the front 112 of the cowling 100. The drain gutter 150 is configured to convey water from the lid 128 to the port side 116 and the starboard side 118 of the cowling 100. The lid 128 is sloped downwards towards the front 112 of the cowling 100 and includes a front edge portion 152 over which the water on the lid 128 in the closed position drains to the drain gutter 150. The upper front panel 126 of the top cowl 102 has a rear edge 154 which faces a front edge portion 152 of the lid 128 in the closed position. A gap 148 is defined between the rear edge 154 and the front edge portion 152, and water is configured to drain from the lid 128 into the drain gutter 150 through the gap 148.

Referring to FIGS. 4 and 5, the drain gutter 150 includes a port section 156 and a starboard section 158 that are formed in laterally extending portions 160 of the port and starboard side panels 120, respectively. The port and starboard, 158 of the drain gutter 150 meet at an axially extending baffle 164 proximate a lateral midpoint of the cowling 100. The baffle 164 is configured to separate water flowing into the drain gutter 150 for conveyance to the port side 116 via the port section 156 and to the starboard side 118 via the starboard section 158. The port and starboard sections 156, 158 of the drain gutter 150 each extend laterally outward from the baffle 164 towards a respective mouth 166 that opens into the gutter 142 and channel 144 on the side panels 120.

Figure 2:
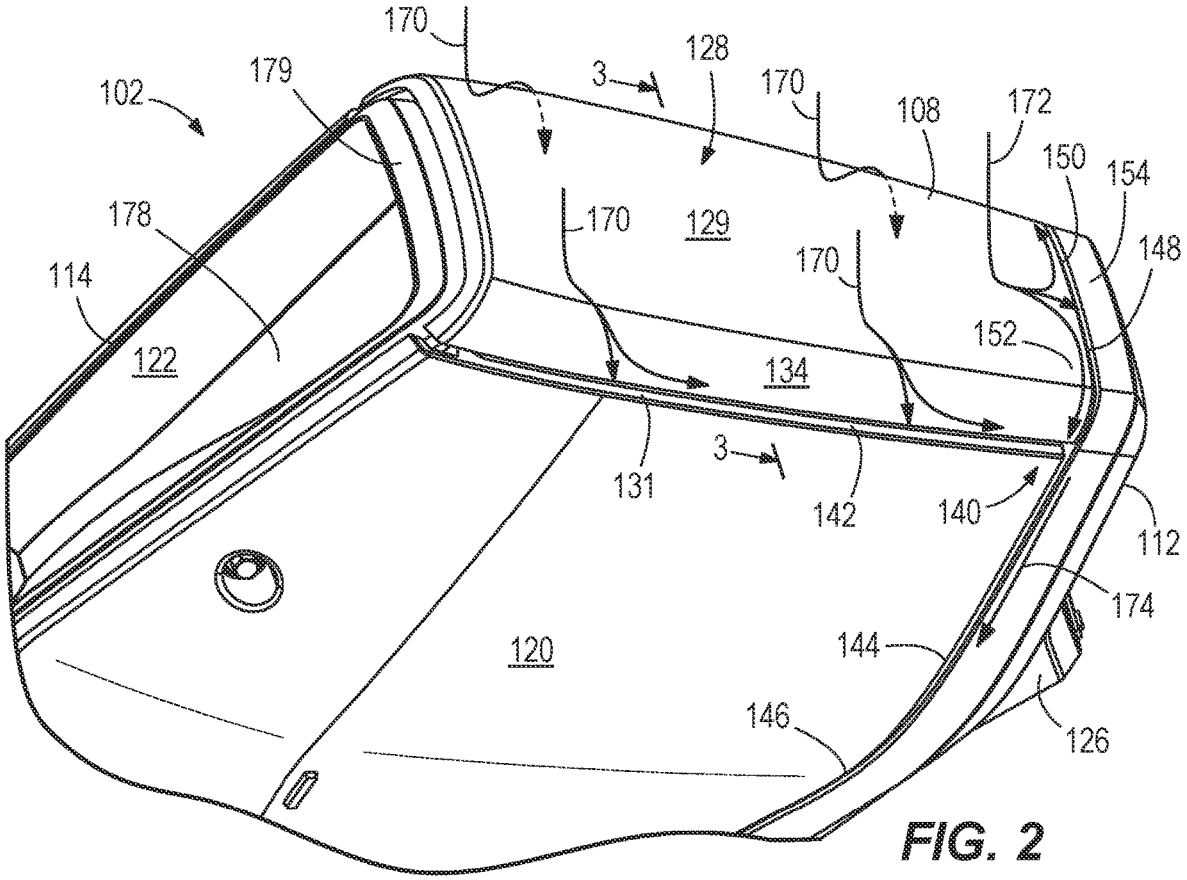
FIG. 2 is a detailed perspective view of the top cowl on the marine drive of FIG. 1.

As best illustrated in FIG. 2, the trough system 140 is configured to drain water from the top cowl 102 and the lid 128 while the marine drive 50 is trimmed down in an operating position. Due at least in part to the slope and curvature of the lid 128, water on the lid 128 is directed towards the front edge portion 152 and the port and starboard edge portions 134 of the lid 128. Water directed towards the port and starboard edge portions 134 generally follows an example flow path indicated by arrows 170 and flows laterally across a top surface 129 of the lid 128, over the respective edge portion 134, and into the gutter 142. Once the water has entered the port or starboard gutter 142, it is directed forward towards the channels 144.

Water on the lid 128 that is directed towards the front 112 of the cowling 100 generally follows an example flow path indicated by arrows 172 and flows longitudinally across the top surface 129 of the lid 128, over the front edge portion 152, and into the drain gutter 150. Water entering the drain gutter 150 through the gap 148 is separated and directed into the port section 156 or the starboard section 158 by the baffle 164. Water separated into the port section 156 of the drain gutter 150 flows laterally outward towards the port side 116 and downwards into the port channel 144. Water separated into the starboard section 158 of the drain gutter 150 flows laterally outward towards the starboard side 118 and downwards into the starboard channel 144. Water directed into the channels 144 via the longitudinally extending gutters 142 and the drain gutter 150 generally follows the example flow path indicated by arrow 174 downwardly through the channels 144 towards the bottom 110 of the top cowl 102.

Figure 6:
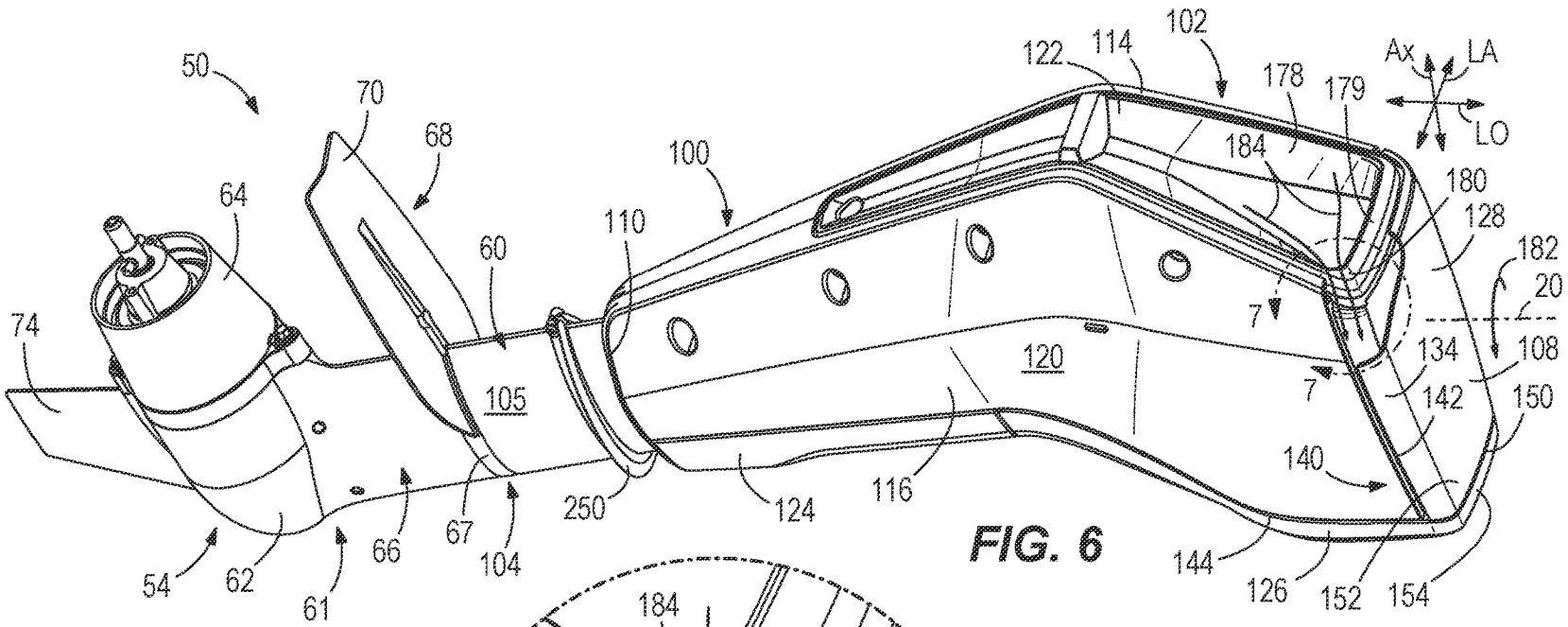
FIG. 6 is a perspective view of the marine drive of FIG. 2 with the marine drive in a trimmed-up position.
Figure 7:
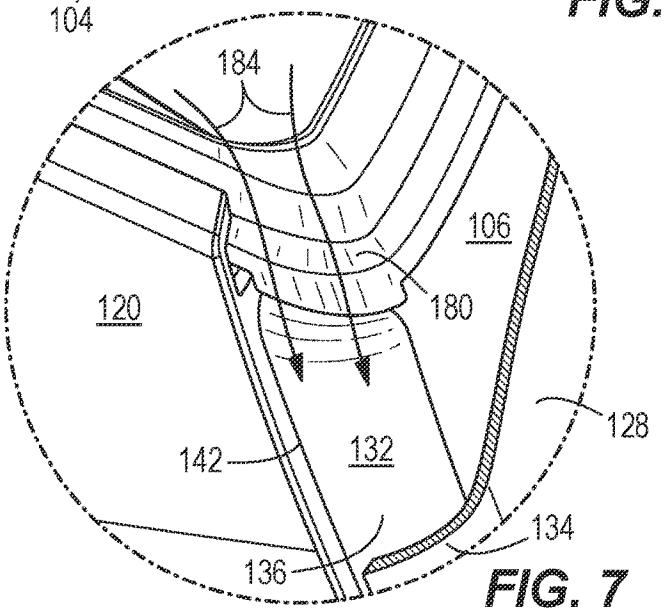
FIG. 7 is a view of section 7-7, taken in FIG. 6.

Some embodiments of a cowling 100 for a marine drive 50 may include features for draining water from the cowling 100 when the marine drive 50 and/or cowling 100 is trimmed up into a raised position in which the steering axis 20 is generally parallel to the longitudinal axis LO, as illustrated in FIG. 6. Referring to FIGS. 6 and 7, the rear panel 122 of the top cowl 102 has a recess 178 configured as a grab area that mat be used to manually tilt the marine drive 50 and/or cowling 100. For example, a user may grasp and pull on the upper edge 179 of the recess 178 to pivot the marine drive upward about the tilt axis 22. When the cowling 100 is trimmed up about the lateral trim axis 22, water may collect in the recess 178. The rear panel 122 includes a deflector surface 180 configured to drain the water from the cowling 100 when the cowling 100 is steered out of a center position relative to the steering axis 20. For example, as illustrated in FIG. 6, the cowling 100 is rotated counterclockwise about the steering axis 20 in the direction of arrow 182 to drain the water towards the port side 116. The marine drive 50 may alternatively by rotated in the opposite clockwise direction about the steering axis 20 to drain the water towards the starboard side 118.

The deflector surface 180 extends over the upper lip 132 of the top cowl 102 such that water flowing over the deflector surface 180 from the recess 178 generally follows the example flow path indicated by arrows 184 into the port or starboard gutter 142. The overlap between the deflector surface 180 and the upper lip 132 may help to reduce the flow of water into the interior 106 of the cowling 100. The gutters 142, which are oriented vertically when the cowling 100 is trimmed up, may then direct the water downwardly towards the front 112 of the cowling 100.

Figure 8:
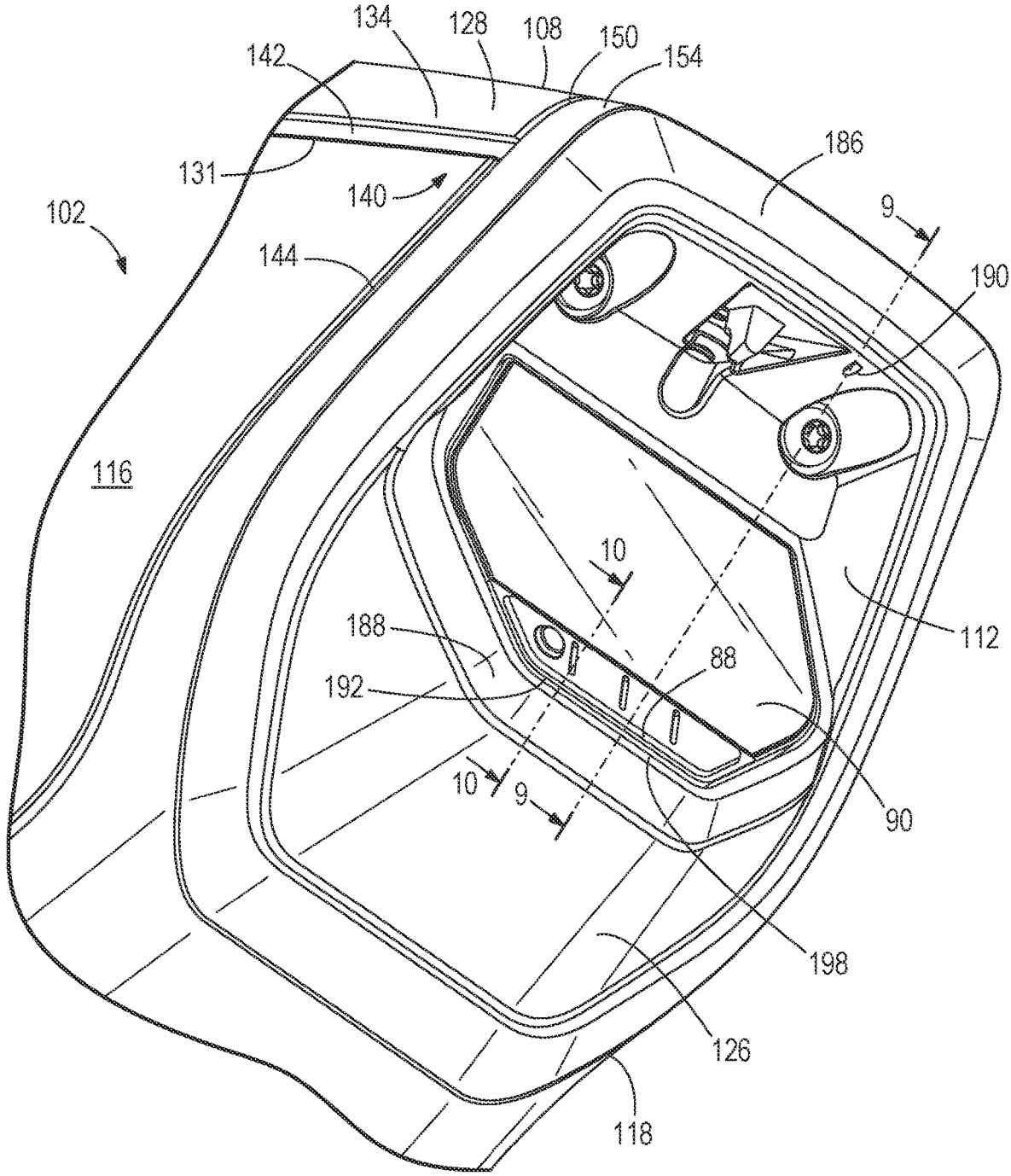
FIG. 8 is a is a detailed perspective view of the front cowl panel on the marine drive of FIG. 6.

Embodiments of a cowling 100 may include at least one of the front panels 124, 126 may include at least one drain hole 190, 192 draining water from the interior 106 of the cowling 100 when the cowling is trimmed up about the trim axis 22. For example, referring to FIGS. 8-10, the upper front panel 126 includes two drain holes 190, 192 for draining the water from inside the cowling interior 106 when the cowling 100 is trimmed up about the lateral trim axis 22. The upper front panel 126 includes two sumps 186, 188 configured to collect water that has entered the cowling interior 106. A first sump 188 is located below and adjacent the display screen 90 and a second sump 188 is located proximate the top 108 of the cowling 100.

Figure 9:
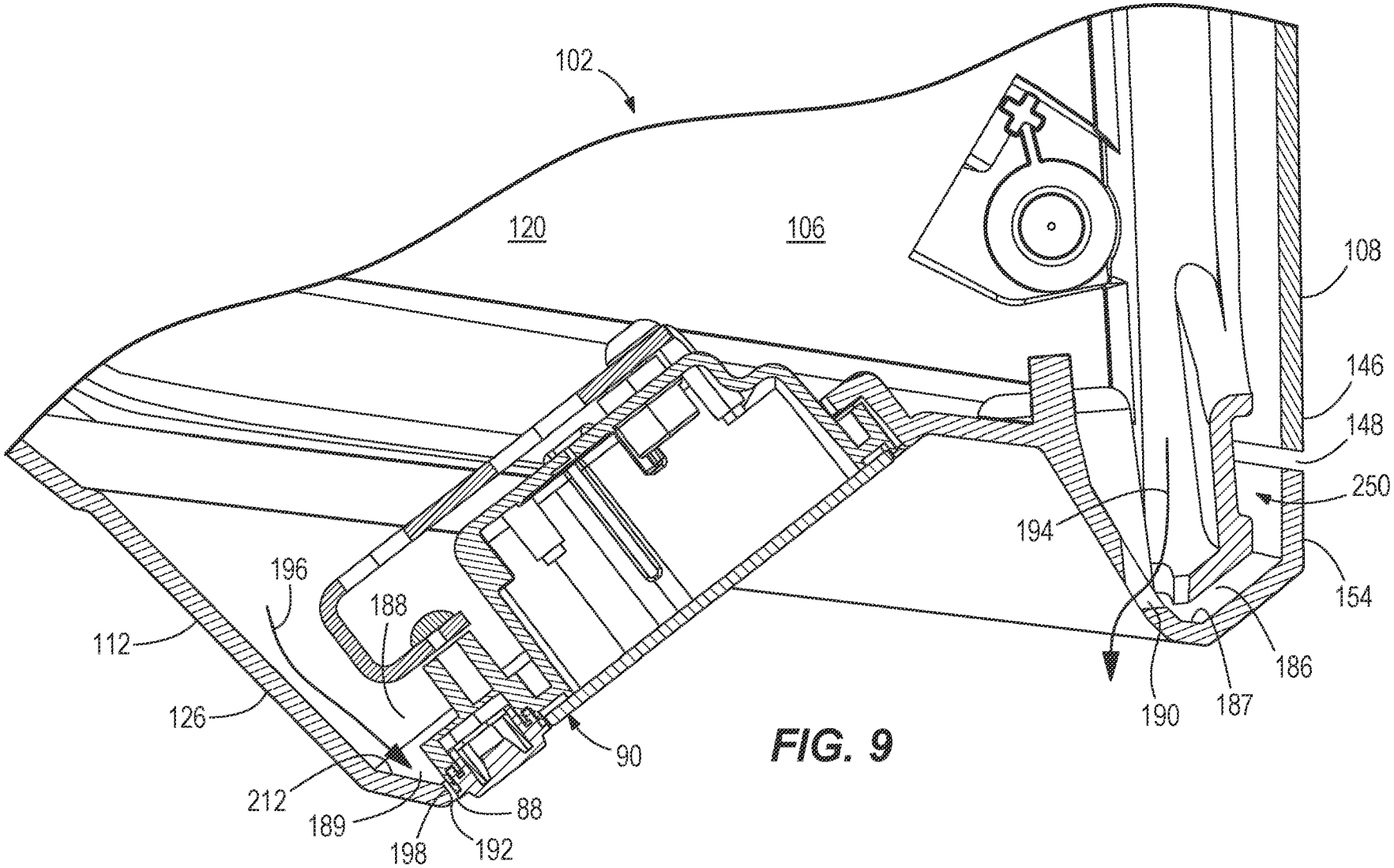
FIG. 9 is a view of section 9-9, taken in FIG. 8.

As best illustrated in FIG. 9, a first drain hole 190 is formed through the upper front panel 126 proximate the bottom 187 of the first sump 186. The first drain hole 190 provides a passage between the interior of the cowling and the exterior and is configured to drain water that collects in the first sump 186 along the example flow path indicated by arrow 194.

Figure 10:
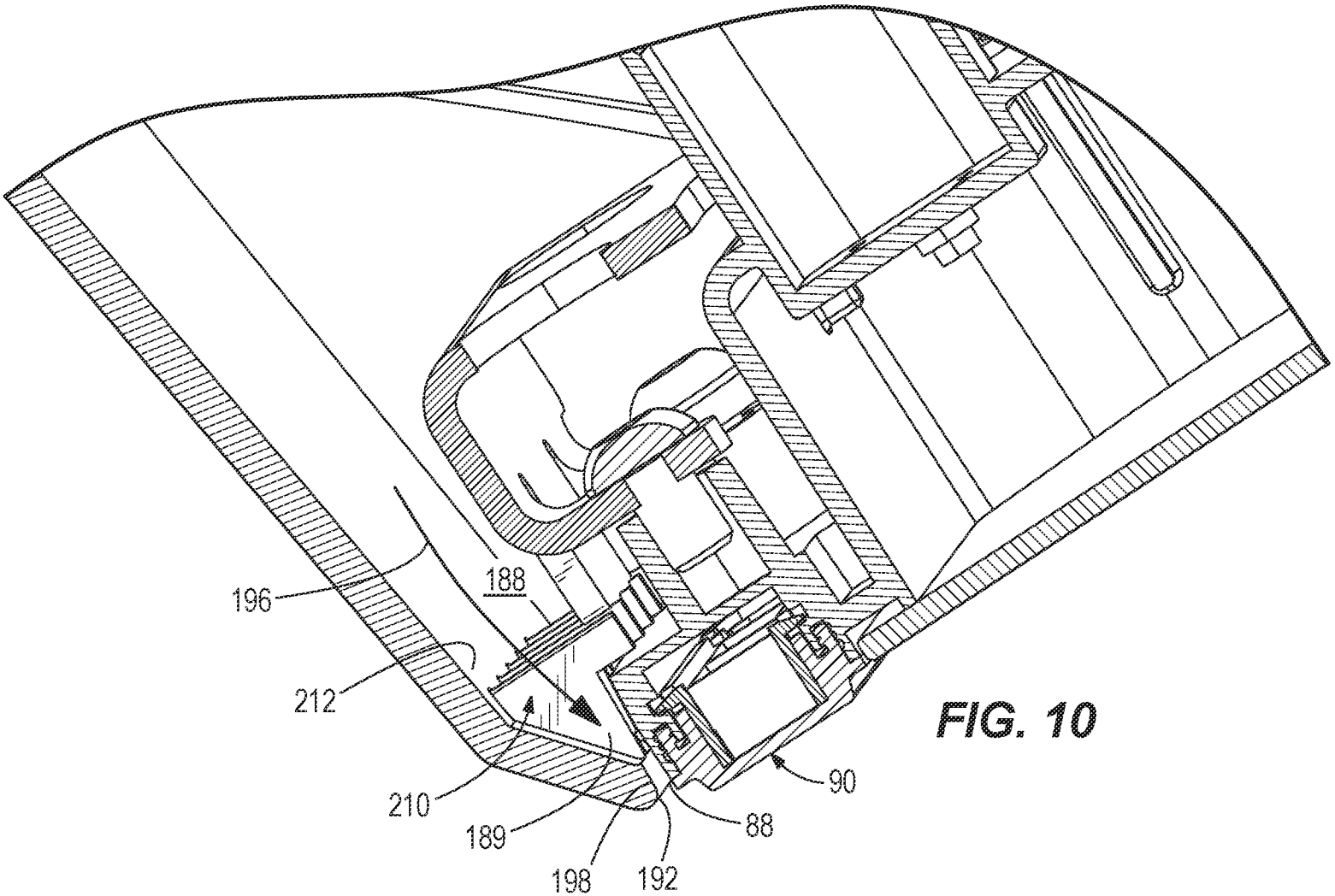
FIG. 10 is a view of section 10-10, taken in FIG. 8.

A second drain hole 192 is formed through the upper front panel 126 proximate the bottom 189 of the second sump 188. In the illustrated embodiments, the second drain hole 192 is configured as a slot 198 that extends longitudinally along a lower edge 88 of the display screen 90. As best illustrated in FIG. 10, a plurality of standoffs 210 support the display screen 90 relative to an interior surface 212 of the upper front panel 126 to limit water damage to the display screen 90. The illustrated standoffs 210, which are configured as a plurality of ribs, allow water to flow between the ribs, past the lower edge 88 of the display screen 90, and out from the cowling interior 106 via the second drain hole 192 along the example flow path indicated by arrow 196.

In the illustrated embodiments, the first and second drain holes 190, 192 are positioned in the front 112 of the cowling 100 so that they may drain water from the cowling interior 106 when the cowling 100 is in different trim positions. The first drain hole 190 is configured for draining water from inside the cowling interior 106 when the cowling 100 is in a full trim position, as shown in FIG. 6. The second drain hole 192 is configured for draining water from inside the cowling interior 106 when the cowling 100 is in a partial trim position between the fully raised position (FIG. 6) and the lower position (FIG. 1).

Some embodiments may include at least one drain hole that is differently shaped, sized, or positioned than those of the illustrated embodiments. For example, the first drain hole may be configured as a slot or a plurality of drain holes and/or the second drain hole may be configured as a single hole, or as a plurality of separate holes. Some embodiments may include additional drain holes in at least one of the front panels 124, 126, and some embodiments may omit at least one of the illustrated drain holes 190, 192.

As previously mentioned, the cowling 100 includes a lower cowl 104 formed by the extension leg 60, the head 67 of the anti-ventilation plate 68, and the stem 66. The extension leg. 60, the head 67 of the anti-ventilation plate 68, and the stem 66 each include a respective perimeter side wall 234, 236, 238 that define a hollow interior 240 of the lower cowl 104. The radially outer profiles of the extension leg 60, the head 67, and the stem 66 generally match each other, in particular such that these components together provide a smooth outer surface which is streamlined and encounters minimal hydrodynamic drag as the marine vessel travels through the water. A rigid conduit or tube 242 extends through the lower cowl interior 240 from a top end in the top cowl 102 and a bottom end received in a cylindrical stack 244 extending up from the torpedo housing 54. The radially outer surface of the tube 94 is sealed against the radially inner surface of the cylindrical stack 244, for example with an O-ring or other gasket, to prevent the ingress of water into the torpedo housing 54. The lower cowl 104 may include at least one drain hole 246 for draining water from inside the lower cowl. In the illustrated embodiments, the lower cowl 104 includes two drain holes 246 formed through the side of the lower cowl 104 proximate a bottom end 248 of the lower cowl 104. The drain holes 246 allow water to drain from inside the interior 240 of the lower cowl 104 along example flow paths indicated by arrows 247. Some embodiments, however, may include a different drain hole configuration. For example, the lower cowling may include a different number of drain holes, and/or at least one drain hole may be in a different location than those of the illustrated embodiments.

Some embodiments of a marine drive 50 may include features of draining water from the lower end portion 103 of the top cowl 102. For example, referring to FIG. 11, the bottom 110 of the top cowl 102 includes an opening 220 through which the extension leg 60 extends. A gap 222 is defined between an outer surface 224 of the extension leg 60 of the lower unit 61 and a rim 226 of the opening 220 at the lower end portion 103 of the top cowl 102. Water can drain from the top cowl 102 through the gap 222, for example along the example flow path indicated by arrows 230.

To reduce or prevent the ingress of water into the top cowl 102 via the gap 222 defined by the opening 220, embodiments of a marine drive 50 may include a splash plate 250 located between the top cowl 102 and the torpedo housing 5. Referring to FIGS. 11-15, the splash plate 250 is positioned on the lower unit 61 located between the top cowl 102 and the anti-cavitation plate 70 and includes a collar 252 and a flange 254 which extends radially outwardly from the lower unit 61 and is configured to deflect any water traveling upwards away from the opening 220, for example along the example flow path indicated by arrow 256 in FIG. 11.

Figure 13:
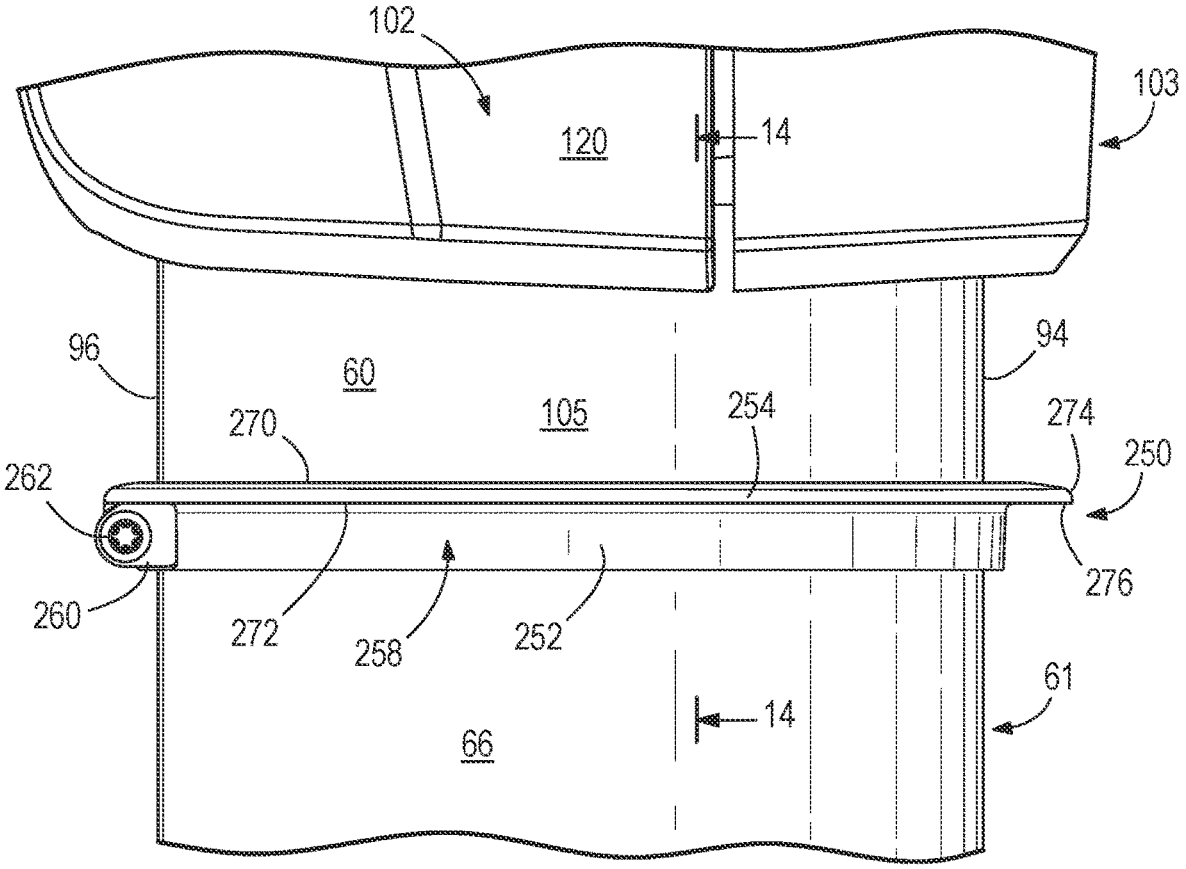
FIG. 13 is a side view of the splash plate.
Figure 14:
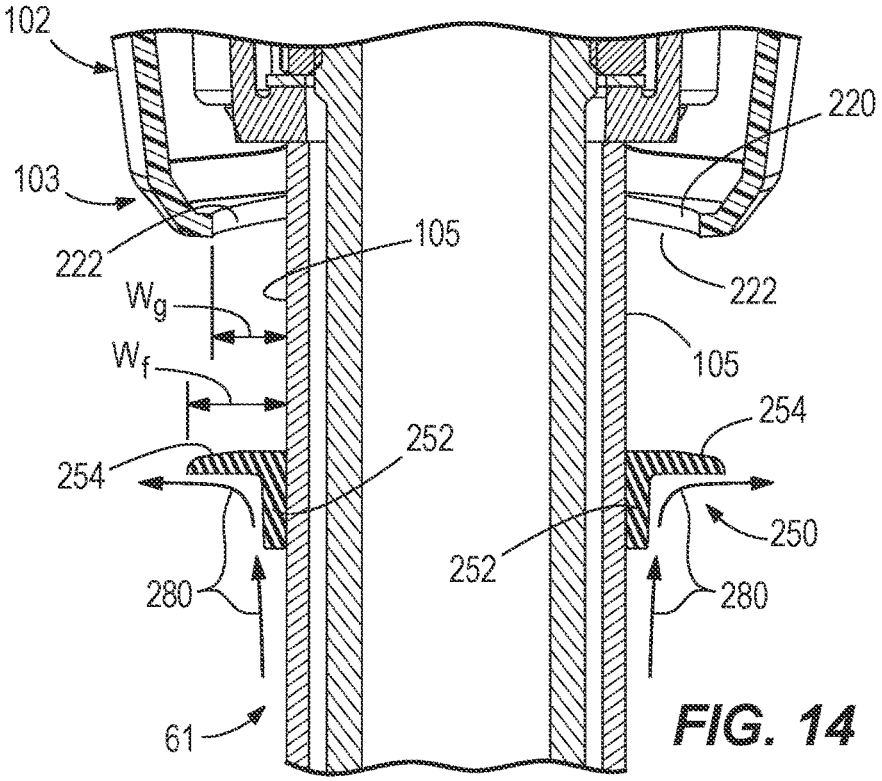
FIG. 14 is a view of section 14-14, taken in FIG. 14.
Figure 15:
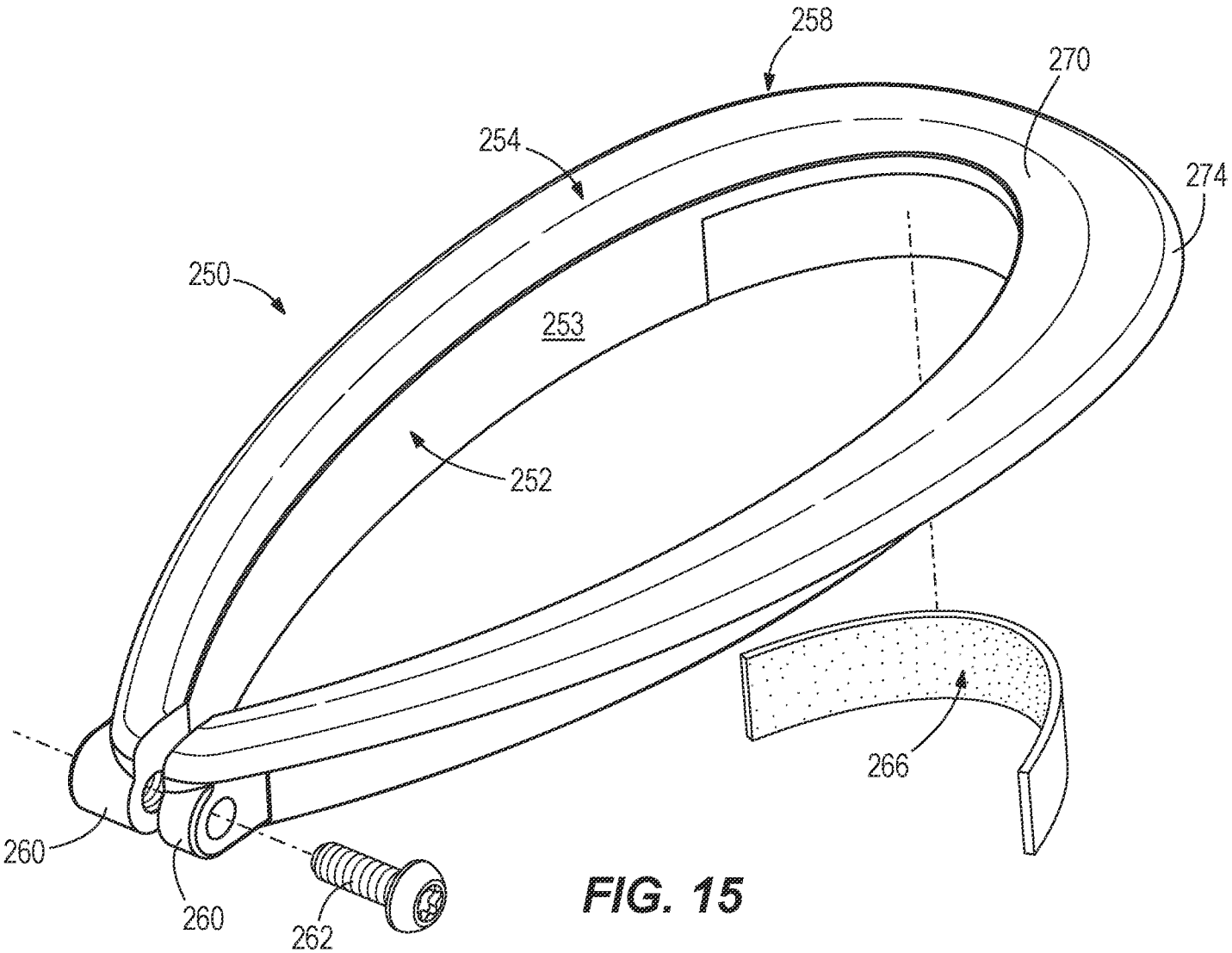
FIG. 15 is an exploded perspective view of the splash plate.

With continued reference to FIGS. 12-15, the illustrated splash plate 250 is configured as an elongated flexible member 258 having a curved shape which can be deformed out of said curved shape during installation on an outer surface 105 of the lower unit 61. The lower unit 61 has an outer profile which is a tear-drop shape having a wider width at a forward side 94 of the lower unit 61 and a relatively narrower width at a rearward side 96 of the lower unit 61. The curved shape of the elongated flexible member 258 is a corresponding tear-drop shape. The splash plate 250 is clamped to the lower unit 61 such that the collar 252 abuts and extends around the outer surface 105 of the lower unit 61. After installation, the elongated flexible member 258 tends to return to its curved shape, facilitating retention of the splash plate 250 in place on the outer surface 105 of the lower unit 61. Additionally or alternatively, as illustrated in FIG. 15, a pressure sensitive adhesive tape 266 may be disposed between the collar 252 and the outer surface 105, thereby adhering an inner surface 253 of the collar 252 to the outer surface 105 of the lower unit 61.

The elongated flexible member 258 has opposing ends 260 and is clamped to the outer surface 105 of the lower unit 61 by a fastener 262, which fastens the opposing ends 260 together. In the illustrated embodiments, for example, the splash plate is clamped to an outer surface 105 of the lower unit 61 by only one fastener 262 that is located along a rearward side 96 of the lower unit 61 and laterally extends into the opposing ends 260 of the elongated flexible member 258.

Figure 12:
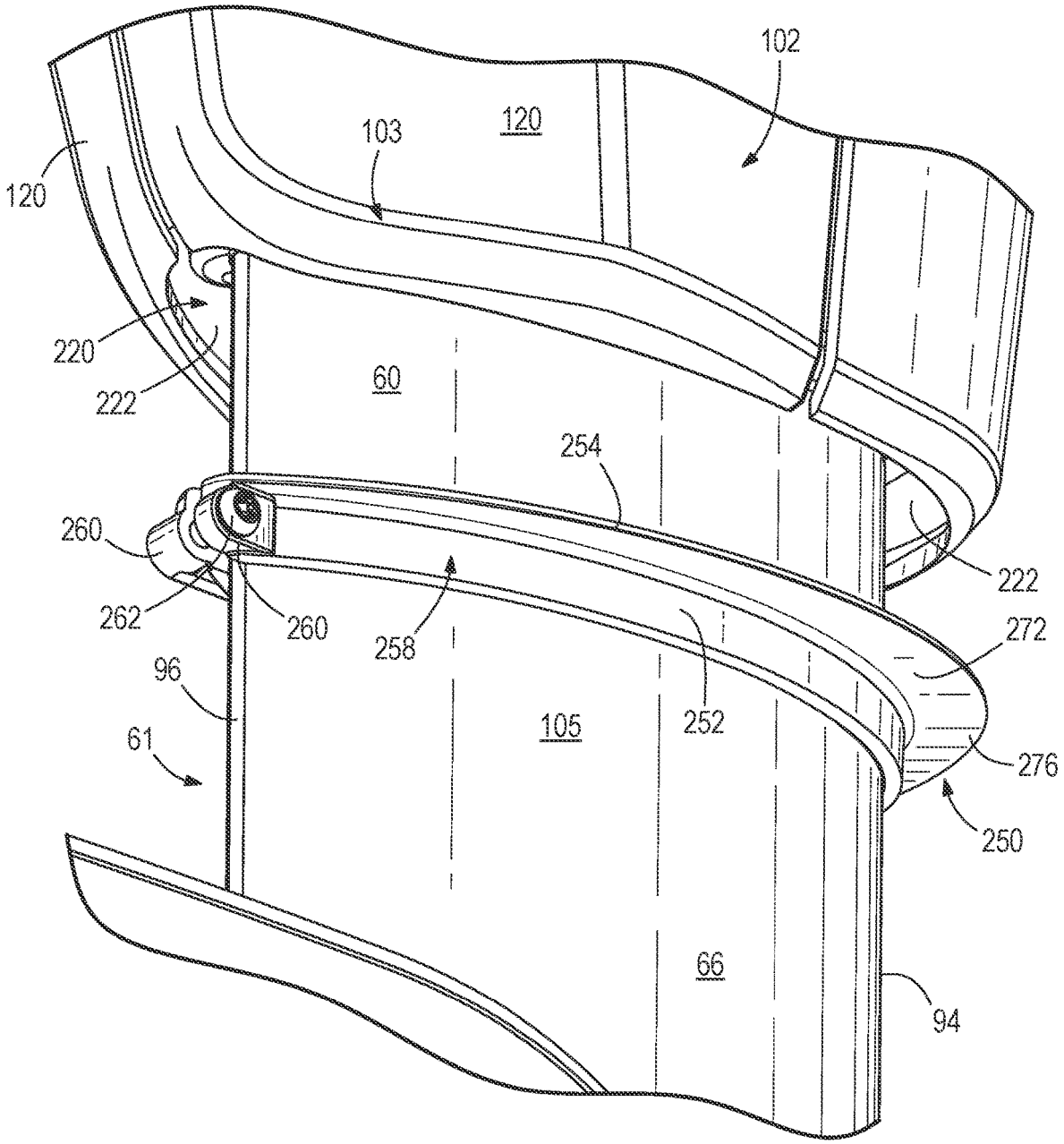
FIG. 12 is a detailed perspective view of the splash plate.

With continued reference to FIGS. 12-15, the flange 254 extends from and around the outer surface 105 at a top side of the collar 252 such that flange 254 is located between the top cowl 102 and the collar 252. The flange 254 is generally planar and has an upper surface 270 and a lower surface 272 which are likewise generally planar. In the illustrated embodiments, the upper surface 270 is generally flat between the outer surface 105 of the lower unit 61 and outer perimeter portion 274 of the upper surface 270, which curves downward (FIG. 15). The lower surface 272 of the flange 254 is completely flat and has an outer perimeter portion 276 that is completely flat (FIG. 13). This may be useful, for example, to prevent water from spraying upwards and into the marine vessel or onto a user. Some embodiments of a splash plate, however, may include a flange that includes at least one portion that is not flat. For example, a lower surface my be sloped and/or curved upwards and/or downwards along at least a portion of the outer perimeter.

As best illustrated in FIGS. 12 and 15, the width $W_f$ of the flange 254 may vary along the elongated flexible member 258. Referring to FIG. 14, proximate the forward side 94 of the lower unit 61, the width of the flange 254 is greater than the width of the flange 254 proximate the rearward side 96 of the lower unit 61. At least around the forward side 94 of the lower unit 61, the width of the flange 254 is greater than a width of the gap 222 into the top cowl 102 at the lower end portion 103 thereof. As the marine drive 50 propels the marine vessel through the water, splashed upwards as it contacts the lower unit 61 is redirected away from the gap 222 by the lower surface 272 of the flange 254, for example along the flow path indicated by arrows 280. Some embodiments may include a splash plate that is differently shaped, sized, or positioned that the illustrated splash plate 250.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An outboard marine drive comprising:

a supporting frame;

a lower unit suspended from the supporting frame and configured to support a propulsor;

a top cowl on the supporting frame, wherein a gap is defined between a lower end portion of the top cowl and the supporting frame or the lower unit; and a splash plate configured to reduce flow of water into the gap, the splash plate including an elongated flexible member having a curved shape that is deformable during installation of the splash plate onto an outer surface of the lower unit, the elongated flexible member tending to return to said curved shape after said installation to facilitate retention of the splash plate on the lower unit, wherein the elongated flexible member has opposing ends that are fastened together to clamp the splash plate to the lower unit.

2. The outboard marine drive according to claim 1, the splash plate including a flange radially outwardly extending from the lower unit.

3. The outboard marine drive according to claim 2, the flange including a radially lower surface having an outer perimeter that is completely flat.

4. The outboard marine drive according to claim 2, the flange having a width that is larger than a width of the gap.

5. The outboard marine drive according to claim 4, wherein the width of the flange is greater along a forward side of the lower unit than along a rearward side of the lower unit.

6. The outboard marine drive according to claim 1, wherein the splash plate is located between the top cowl and a torpedo housing of the outboard marine drive.

7. The outboard marine drive according to claim 1, wherein the splash plate is located between the top cowl and an anti-cavitation plate of the outboard marine drive.

8. The outboard marine drive according to claim 1, wherein the splash plate is clamped to the lower unit by only one fastener.

9. The outboard marine drive according to claim 8, wherein said one fastener is located along a rear side of the lower unit.

10. The outboard marine drive according to claim 1, wherein the lower unit has an outer profile having a tear-drop shape with a wider width at a forward side of the lower unit and a relatively narrower width at a rearward side of the lower unit, and wherein the curved shape of the elongated flexible member is a corresponding tear-drop shape.

11. The outboard marine drive according to claim 1, wherein the splash plate is clamped to the lower unit by only one fastener fastening the opposing ends together.

12. The outboard marine drive according to claim 11, wherein the fastener laterally extends into the opposing ends.

13. The outboard marine drive according to claim 1, wherein the splash plate includes a collar and a flange that radially outwardly extends from the collar.

14. An outboard marine drive comprising:

a supporting frame;

a lower unit suspended from the supporting frame and configured to support a propulsor;

a top cowl on the supporting frame, wherein a gap is defined between a lower end portion of the top cowl and the supporting frame or the lower unit; and a splash plate on the lower unit, the splash plate being configured to reduce flow of water into the gap, wherein the splash plate includes a collar and a flange that radially outwardly extends from the collar, the flange being located between the top cowl and the collar.

15. An outboard marine drive comprising:

a supporting frame;

a lower unit suspended from the supporting frame and configured to support a propulsor;

a top cowl on the supporting frame, wherein a gap is defined between a lower end portion of the top cowl and the supporting frame or the lower unit;

a splash plate on the lower unit, the splash plate being configured to reduce inflow of water into the gap, the splash plate including a collar and a flange that radially outwardly extends from the collar; and pressure sensitive adhesive tape adhering an inner surface of the collar to an outer surface of the lower unit.

16. A splash plate for an outboard marine drive, the splash plate comprising:

an elongated flexible member having opposing ends and a curved shape, wherein the elongated flexible member is deformable during installation on an outer surface of a lower unit of the outboard marine drive;

wherein the elongated flexible member tends to return to said curved shape after said installation and facilitate retention of the splash plate on the lower unit; and wherein the splash plate is configured to be clamped to the lower unit by a fastener fastening the opposing ends together.

17. The splash plate according to claim 16, wherein the fastener is the only fastener fastening the opposing ends together.

* * * * *